US010764968B2

(12) United States Patent
Taimura

(10) Patent No.: US 10,764,968 B2
(45) Date of Patent: Sep. 1, 2020

(54) HEATER AND GLOW PLUG INCLUDING THE SAME

(71) Applicant: KYOCERA Corporation, Kyoto-shi, Kyoto (JP)

(72) Inventor: Kotaro Taimura, Kirishima (JP)

(73) Assignee: Kyocera Corporation, Kyoto (JP)

( * ) Notice: Subject to any disclaimer, the term of this patent is extended or adjusted under 35 U.S.C. 154(b) by 279 days.

(21) Appl. No.: 15/779,392

(22) PCT Filed: Sep. 28, 2016

(86) PCT No.: PCT/JP2016/078676
§ 371 (c)(1),
(2) Date: May 25, 2018

(87) PCT Pub. No.: WO2017/090313
PCT Pub. Date: Jun. 1, 2017

(65) Prior Publication Data

US 2018/0310364 A1 Oct. 25, 2018

(30) Foreign Application Priority Data

Nov. 27, 2015 (JP) ..... 2015-232035

(51) Int. Cl.
*H05B 3/48* (2006.01)
*F23Q 7/00* (2006.01)
(Continued)

(52) U.S. Cl.
CPC ..... *H05B 3/48* (2013.01); *F23Q 7/00* (2013.01); *F23Q 7/001* (2013.01); *H05B 3/06* (2013.01);
(Continued)

(58) Field of Classification Search
CPC ..... H05B 1/02; H05B 1/0236; H05B 3/03; H05B 3/06; H05B 3/10; H05B 3/18;
(Continued)

(56) References Cited

U.S. PATENT DOCUMENTS 4,502,430 A * 3/1985 Yokoi ..... F23Q 7/001 123/145 A
8,530,802 B2 * 9/2013 Yamamoto ..... H05B 3/141 123/145 R (Continued)

FOREIGN PATENT DOCUMENTS

JP 2015-018625 A 1/2015

*Primary Examiner* — Brian W Jennison
(74) *Attorney, Agent, or Firm* — Volpe and Koenig, P.C.

(57) ABSTRACT

A heater includes: a ceramic body having a rod-like shape; and a heat generating resistor embedded in the ceramic body, the heat generating resistor including a first straight line section, a second straight line section which is disposed alongside the first straight line section, and a folded section which connects the first straight line section and the second straight line section, in a transverse cross section of the heater, the first straight line section having a shape having a first major axis, the second straight line section having a shape having a second major axis, the second major axis being inclined with respect to the first major axis, a centroid of the first straight line section and the second straight line section being deviated from a centroid of the ceramic body to a side on which a distance between the first major axis and the second major axis is narrower.

4 Claims, 4 Drawing Sheets

(51) Int. Cl.
*H05B 3/06* (2006.01)
*H05B 3/10* (2006.01)
*H05B 3/18* (2006.01)

(52) U.S. Cl.
CPC ..... *H05B 3/10* (2013.01); *H05B 3/18* (2013.01); *H05B 2203/027* (2013.01)

(58) Field of Classification Search
CPC ..... H05B 3/141; H05B 3/0042; H05B 3/48; H05B 2203/027; F23Q 7/001; F23Q 7/22
See application file for complete search history.

(56) References Cited

U.S. PATENT DOCUMENTS

| | | | | |
|---|---|---|---|---|
| 9,651,257 | B2 * | 5/2017 | Taimura | H05B 3/48 |
| 9,702,559 | B2 * | 7/2017 | Hiura | F23Q 7/001 |
| 10,533,744 | B2 * | 1/2020 | Taimura | F23Q 7/06 |
| 2006/0011602 | A1 * | 1/2006 | Konishi | F23Q 7/001 219/270 |
| 2013/0284714 | A1 * | 10/2013 | Okamura | H05B 3/42 219/270 |
| 2013/0291819 | A1 * | 11/2013 | Yonetamari | H05B 3/48 123/143 B |
| 2014/0053795 | A1 * | 2/2014 | Hiura | H05B 3/48 123/145 A |
| 2015/0014302 | A1 * | 1/2015 | Ikai | F23Q 7/001 219/544 |

* cited by examiner

HEATER AND GLOW PLUG INCLUDING THE SAME

TECHNICAL FIELD

The present invention relates to a heater used as, for example, a heater for ignition or flame sensing in a combustion type in-vehicle heating apparatus, a heater for ignition of various types of combustion appliances such as an oil fan heater, a heater for a glow plug of a diesel engine, a heater for various sensors such as an oxygen sensor, or a heater for heating of a measuring instrument, and a glow plug including the same.

BACKGROUND ART

As a heater, a heater described in, for example, Japanese Unexamined Patent Publication JP-A 2015-18625 (hereinafter, also referred to as "Patent Literature 1") is known. The heater described in Patent Literature 1 includes a ceramic body and a heat generating resistor provided within the ceramic body. The heat generating resistor has two straight line sections and a folded section which connects the two straight line sections. In recent years, improvement of a rate of temperature rise has been demanded of a heater.

In a cross section of the heater described in Patent Literature 1 perpendicular to an axial direction of the two straight line sections, the two straight line sections each have a shape having a major axis and these major axes are in a parallel relationship. Furthermore, a centroid of the two straight line sections is located on a line dividing the ceramic body in half. Owing to this, heat generated from the two straight line sections is prone to be confined in an intermediate portion between the two straight line sections in the ceramic body. As a result, it has been difficult to improve a rate of temperature rise of a surface of the ceramic body that is to come in contact with an object to be heated.

SUMMARY OF INVENTION

A heater includes: a ceramic body having a rod-like shape; and a heat generating resistor embedded in the ceramic body, the heat generating resistor comprising a first straight line section, a second straight line section which is disposed alongside the first straight line section, and a folded section which connects the first straight line section and the second straight line section, in a cross section of the heater taken along a plane which passes through the first straight line section and which is perpendicular to an axial direction of the ceramic body, the first straight line section having a shape having a first major axis, the second straight line section having a shape having a second major axis, the second major axis being inclined with respect to the first major axis, a centroid of the first straight line section and the second straight line section being deviated from a centroid of the ceramic body to a side on which a distance between the first major axis and the second major axis is narrower.

DESCRITPION OF EMBODIMENTS

Figure 1:
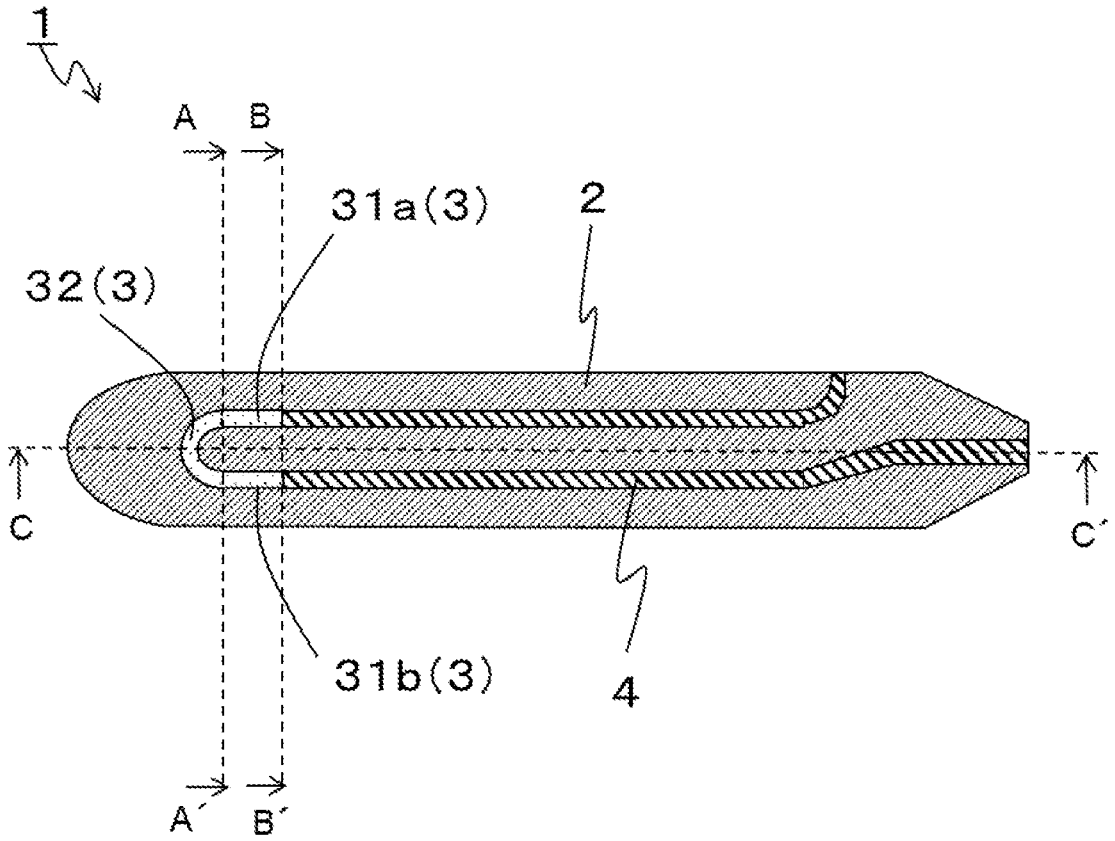
FIG. 1 is a cross-sectional view illustrating an example of a heater.

As illustrated in FIG. 1, a heater 1 includes a ceramic body 2, a heat generating resistor 3 embedded in the ceramic body 2, and leads 4 connected to the heat generating resistor 3 and drawn out to a surface of the ceramic body 2.

The ceramic body 2 in the heater 1 is, for example, a rod-like ceramic body having a longitudinal direction (an axial direction). The heat generating resistor 3 and the leads 4 are embedded in this ceramic body 2. Herein, the ceramic body 2 is formed of ceramics. This makes it possible to provide the heater 1 having high reliability at a time of rapid temperature rise. Examples of ceramics include electrically insulating ceramics such as oxide ceramics, nitride ceramics, and carbide ceramics. The ceramic body 2 may be formed of silicon nitride ceramics. Silicon nitride, which is a main component of silicon nitride ceramics, is excellent in strength, toughness, insulation, and heat resistance.

The ceramic body 2 formed of silicon nitride ceramics can be produced through, for example, the following method. Specifically, a sintering aid, $A1_2O_3$, and $SiO_2$ are mixed into silicon nitride serving as the main component to obtain a mixture. The mixture is molded into a predetermined shape to obtain a molded body. Subsequently, by subjecting the molded body to hot press firing at 1650 to 1780° C., the ceramic body 2 can be obtained. As the sintering aid, a rare-earth element oxide such as 3 to 12% by mass of $Y_2O_3$, $Yb_2O_3$, or $Er_2O_3$ can be used. As $Al_2O_3$, 0.5 to 3% by mass of $Al_2O_3$, for example, can be used. $SiO_2$ can be mixed so that 1.5 to 5% by mass of $SiO_2$ is contained in the ceramic body 2. A length of the ceramic body 2 is set to, for example, 20 to 50 mm, and a diameter of the ceramic body 2 is set to, for example, 3 to 5 mm.

It is noted that, when the ceramic body 2 formed of silicon nitride ceramics is used, $MoSiO_2$, $WSi_2$, or the like may be mixed and dispersed into silicon nitride. In this case, a coefficient of thermal expansion of silicon nitride ceramics which is a base material can be made closer to a coefficient of thermal expansion of the heat generating resistor 3. As a result, durability of the heater 1 can be improved.

The heat generating resistor 3 is disposed inside the ceramic body 2. The heat generating resistor 3 is disposed on a tip end side (one end side) of the ceramic body 2. The heat generating resistor 3 is a member which generates heat by carrying a current thereto. The heat generating resistor 3 comprises a first straight line section 31*a* and a second straight line section 31*b* which extend along the longitudinal direction of the ceramic body 2, and a folded section 32 which connects these straight line sections.

The first straight line section 31*a* and the second straight line section 31*b* are disposed alongside each other. "Being disposed alongside" used herein is not necessarily being parallel in a strict sense. Specifically, the first straight line section 31*a* and the second straight line section 31*b* may be located, for example, in such a manner that a distance between the first straight line section 31*a* and the second straight line section 31*b* is narrower as the first straight line section 31*a* and the second straight line section 31*b* are closer to the folded section 32.

As a material for forming the heat generating resistor 3, a material which contains a carbide, a nitride, a silicide, or the like of W, Mo, Ti, or the like can be used.

Moreover, when the ceramic body 2 is formed of silicon nitride ceramics, the heat generating resistor 3 may contain WC, which is an inorganic electrical conductor, as the main component, and a content of silicon nitride added to WC may be equal to or higher than 20% by mass. Since a conductor component which becomes the heat generating resistor 3 is higher in coefficient of thermal expansion than silicon nitride in the ceramic body 2 formed of, for example, silicon nitride ceramics, the heat generating resistor 3 is normally in a state in which a tensile stress is applied thereto. On the other hand, by adding silicon nitride into the heat generating resistor 3, it is possible to make the coefficient of thermal expansion of the heat generating resistor 3 closer to that of the ceramic body 2 and to alleviate the stress due to a difference in the coefficient of thermal expansion between the heat generating resistor 3 and the ceramic body 2 at a time of temperature rise and temperature drop of the heater 1.

Furthermore, when the content of silicon nitride contained in the heat generating resistor 3 is equal to or lower than 40% by mass, it is possible to reduce the variation in a resistance value of the heat generating resistor 3. Therefore, the content of silicon nitride contained in the heat generating resistor 3 may be 20 to 40% by mass. Moreover, 4 to 12% by mass of boron nitride can be added, as a similar additive, to the heat generating resistor 3 instead of silicon nitride. A total length of the heat generating resistor 3 can be set to 3 to 15 mm and a cross-sectional area thereof can be set to 0.15 to 0.8 $mm^2$.

The leads 4 are members for electrically connecting the heat generating resistor 3 to an external power supply. The leads 4 are connected to the heat generating resistor 3 and drawn out to the surface of the ceramic body 2. Specifically, the leads 4 are joined to two end portions of the heat generating resistor 3. One of the leads 4 is connected, on one end side, to one end of the heat generating resistor 3 and is led out, on the other end side, from a side surface of the ceramic body 2 which is closer to a rear end of the ceramic body 2. The other lead 4 is connected, on one end side, to the other end of the heat generating resistor 3 and is led out, on the other end side, from a rear end portion of the ceramic body 2.

The leads 4 are formed of, for example, a similar material to that of the heat generating resistor 3. By making a cross-sectional area of the leads 4 larger than that of the heat generating resistor 3 and making a content of the material for forming the ceramic body 2 lower than that of the material for forming the heat generating resistor 3, a resistance value per unit length of the leads 4 is reduced. Furthermore, the leads 4 may contain WC, which is the inorganic electrical conductor, as a main component, and silicon nitride may be added to the main component so that a content of silicon nitride is equal to or higher than 15% by mass. This can make a coefficient of thermal expansion of the leads 4 closer to that of silicon nitride configuring the ceramic body 2.

Figure 2:
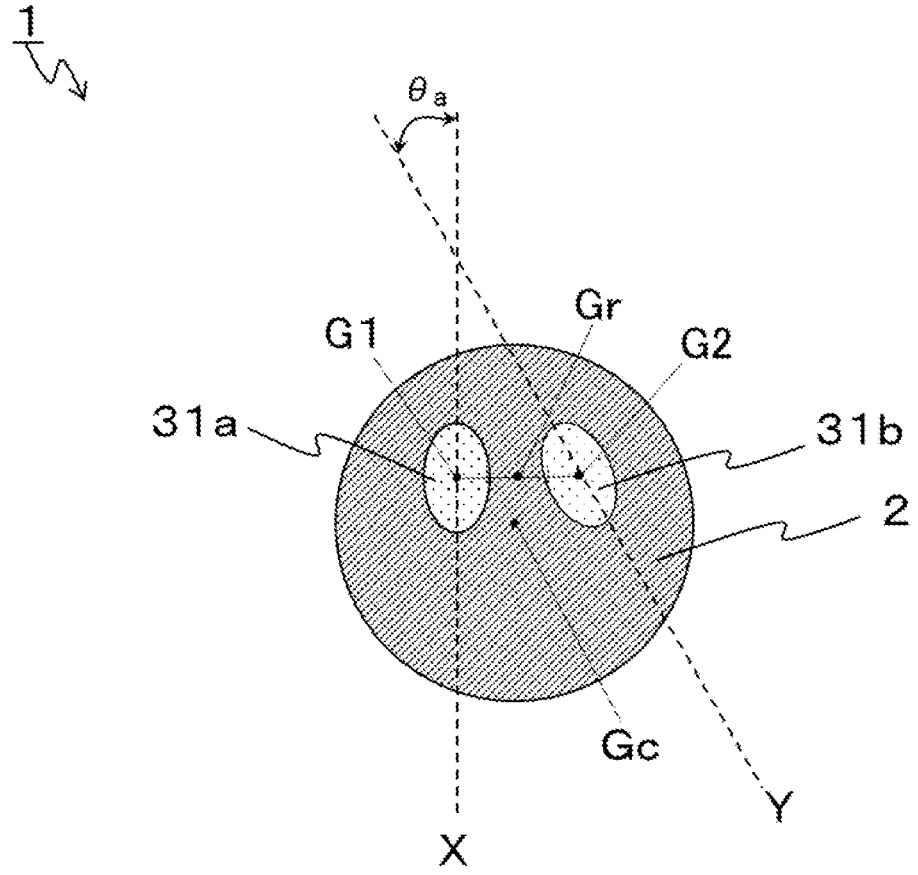
FIG. 2 is a cross-sectional view of the heater illustrated in FIG. 1 in a cross section taken along the line A-A'.
Figure 3:
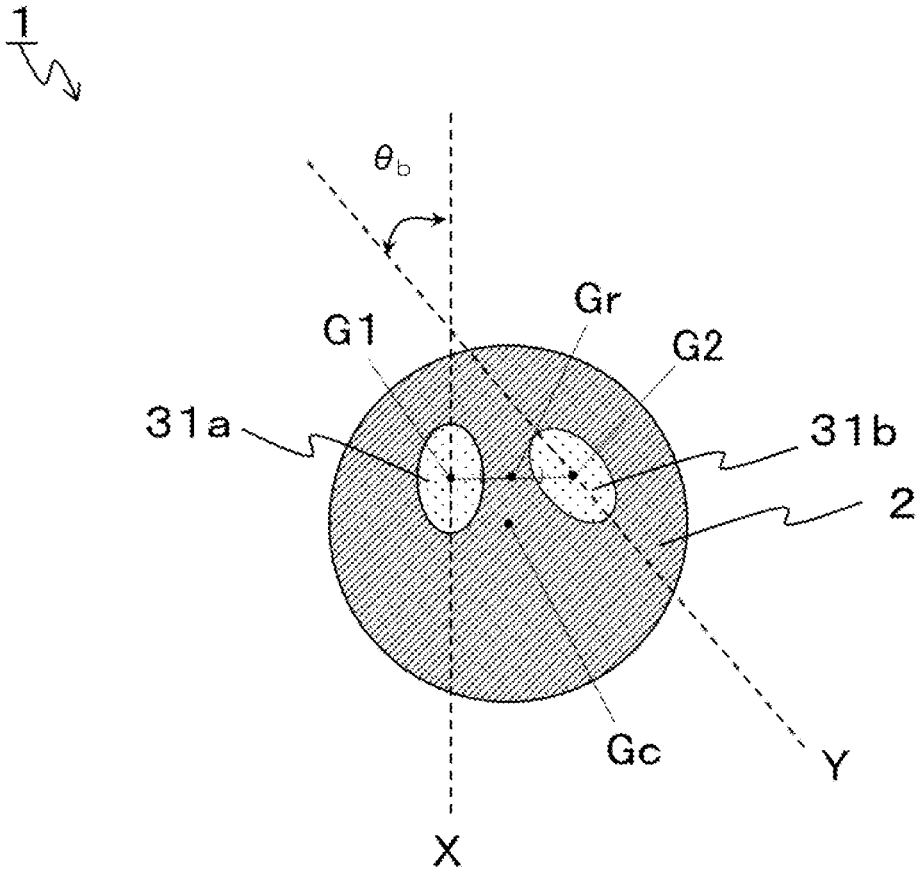
FIG. 3 is a cross-sectional view of the heater illustrated in FIG. 1 in a cross section taken along the line B-B'.

Now, as illustrated in FIGS. 2 and 3, in a cross section of the heater 1 taken along a plane which passes through the first straight line section 31*a* and which is perpendicular to the axial direction of the ceramic body 2, the first straight line section 31*a* has a shape having a first major axis X, the second straight line section 31*b* has a shape having a second major axis Y, and the second major axis Y is inclined with respect to the first major axis X. A centroid Gr of the first straight line section 31*a* and the second straight line section 31*b* is deviated from a centroid Gc of the ceramic body 2 (a centroid of an outer shape of the ceramic body 2, that is, a centroid of the heater 1) to a side on which the distance between the first major axis X and the second major axis Y is narrower. In the cross section of the heater 1 taken along a plane which passes through the first straight line section 31*a* and which is perpendicular to the axial direction of the ceramic body 2, since the first straight line section 31*a* has the shape having the first major axis X, the second straight line section 31*b* has the shape having the second major axis Y, and the second major axis Y is inclined with respect to the first major axis X, this can make it difficult for the heat generated from the first straight line section 31*a* and the second straight line section 31*b* to be confined in an intermediate portion between the first straight line section 31*a* and the second straight line section 31*b* in the ceramic body 2.

Specifically, it is possible to easily increase a temperature on the side on which the distance between the first major axis X and the second major axis Y is narrower in the ceramic body 2. Furthermore, by deviating the centroid Gr of the first straight line section 31*a* and the second straight line section 31*b* from the centroid Gc of the ceramic body 2 to the side on which the distance between the first major axis X and the second major axis Y is narrower, it is possible to easily increase a temperature of a region located on the side on which the distance between the first major axis X and the second major axis Y is narrower on the surface of the ceramic body 2. These results indicate that a temperature of a surface of the heater 1 can be rapidly increased.

A cross-sectional shape of each of the first straight line section 31*a* and the second straight line section 31*b* can be set to, for example, an oval shape or an elliptical shape. The first major axis X means herein a major axis of the cross-sectional shape of the first straight line section 31*a*, and the second major axis Y means herein a major axis of the cross-sectional shape of the second straight line section 31*b*. It is noted that the oval shape, the elliptical shape, or the like is not completely an oval shape, an elliptical shape, or the like and may have stepped portions or irregular portions to a certain extent. The first straight line section 31*a* and the second straight line section 31*b* can be deviated by, for example, about 5 to 30°.

As for the "centroid Gr of the first straight line section 31*a* and the second straight line section 31*b*", a midpoint of a virtual line which connects a centroid G1 of the cross-sectional shape to a centroid G2 of the cross-sectional shape of the second straight line section 31*b* can be defined as the centroid Gr of the first straight line section 31*a* and the second straight line section 31*b*.

In addition, "being deviated to the side on which the distance between the first major axis X and the second major axis Y is narrower" means that the centroid Gr of the first straight line section 31*a* and the second straight line section 31*b* is deviated from the centroid Gc of the cross section of the ceramic body 2 to the side on which the distance between the first major axis X and the second major axis Y is narrower (a side on which extension lines of the first major axis X and the second major axis Y intersect each other) as viewed in a direction perpendicular to an arrangement direction of the first straight line section 31*a* and the second straight line section 31*b*. In other words, the centroid Gr of the first straight line section 31*a* and the second straight line section 31*b* may be deviated in the direction perpendicular to the arrangement direction and may be either completely deviated or not at all deviated in the arrangement direction.

When the cross-sectional shape of the ceramic body 2 is, for example, a circular shape, the centroid Gr of the first straight line section 31*a* and the second straight line section 31*b* can be deviated by, for example, 5 to 40% with respect to a diameter of the ceramic body 2.

Furthermore, as illustrated in FIGS. 2 and 3, in two cross sections of the heater which cross sections are taken along planes which pass through the first straight line section 31*a* and which are perpendicular to the axial direction of the ceramic body 2, an inclination of the second major axis Y with respect to the first major axis X in one cross section out of the two cross sections of the heater may be higher than an inclination of the second major axis Y with respect to the first major axis X in the other cross section, the one cross section being a cross section located farther from the folded section 32, the other cross section being a cross section located closer to the folded section 32.

Moreover, the inclination of the second major axis Y with respect to the first major axis X may be higher as the first straight line section 31*a* and the second straight line section 31*b* are farther from the folded section 32. An interface between the first straight line section 31*a* and the ceramic body 2 and an interface between the second straight line section 31*b* and the ceramic body 2 can be each made into a twisted shape. Therefore, even when cracking occurs to the interfaces, it is possible to suppress the development of the cracking. This makes it possible to improve long-term reliability of the heater 1.

On tip ends of the first straight line section 31*a* and the second straight line section 31*b*, an inclination θa of the second major axis Y with respect to the first major axis X can be set to, for example, 5°. Furthermore, on rear ends of the first straight line section 31*a* and the second straight line section 31*b*, an inclination θb of the second major axis Y with respect to the first major axis X can be set to, for example, 30°.

Figure 4:
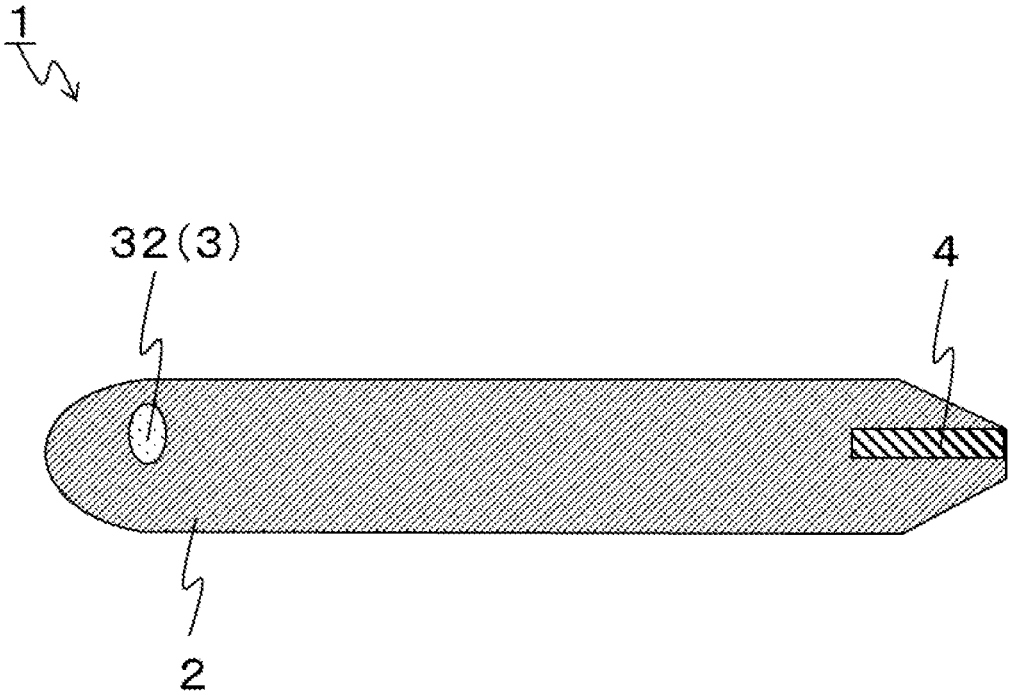
FIG. 4 is a cross-sectional view of the heater illustrated in FIG. 1 in a cross section taken along the line C-C'.

Moreover, when the folded section 32 is viewed at this time, the folded section 32 has a major axis, as well. In addition, as illustrated in FIG. 4, in a tip end portion (central portion) of the folded section 32, the major axis may be orthogonal to a plane including the arrangement direction described above and may be gradually inclined with respect to the plane including the arrangement direction as being farther from the tip end portion. By configuring the folded section 32 in this way, the folded section 32 can make the first straight line section 31*a* and the second straight line section 31*b* smoothly continuous. As a result, a risk of local concentration of the stress in the heater 1 can be reduced.

Furthermore, a point at which the first major axis X and the second major axis Y intersect each other may be located inward of the surface of the ceramic body 2. This can further improve the rate of temperature rise of the surface of the ceramic body 2.

Figure 5:
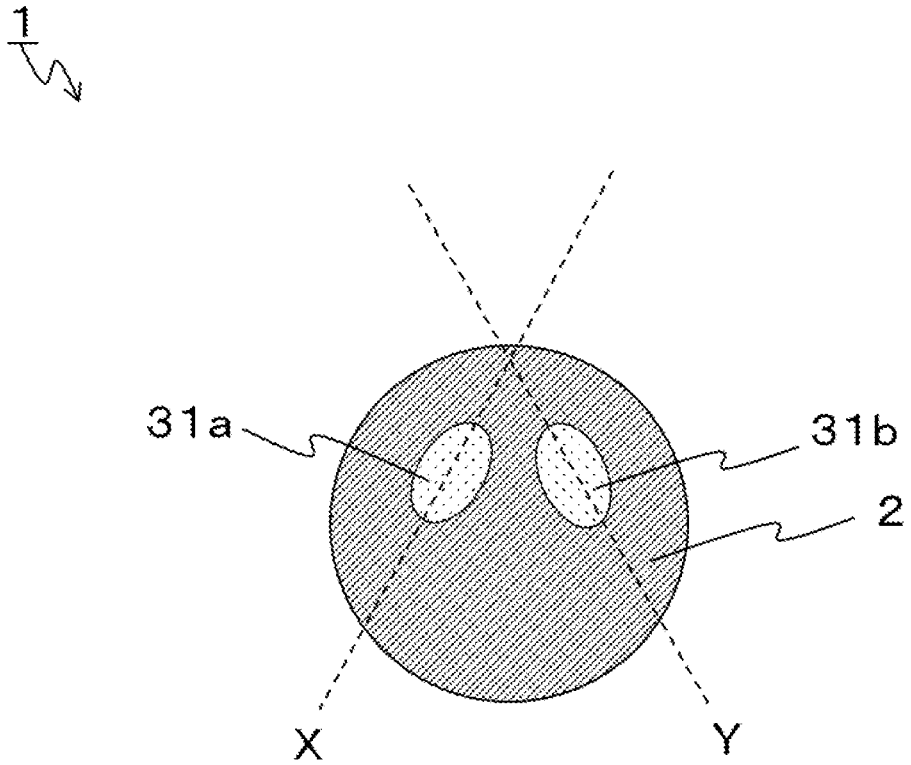
FIG. 5 is a cross-sectional view illustrating another example of a heater.

Moreover, in FIGS. 2 and 3, the first major axis X of the first straight line section 31*a* is located so as to extend in the direction perpendicular to the arrangement direction of the first straight line section 31*a* and the second straight line section 31*b*, and only the second major axis Y of the second straight line section 31*b* is inclined with respect to the arrangement direction. However, the present invention is not limited to this. Specifically, as illustrated in FIG. 5, both the first major axis X of the first straight line section 31*a* and the second major axis Y of the second straight line section 31*b* may be inclined with respect to the arrangement direction. Inclining both the first straight line section 31*a* and the second straight line section 31*b* can widen a region where the distance from the heat generating resistor 3 to the surface of the ceramic body 2 is narrower, which can facilitate increasing the temperature of the region located on the side on which the distance is narrower in a wider range.

Figure 6:
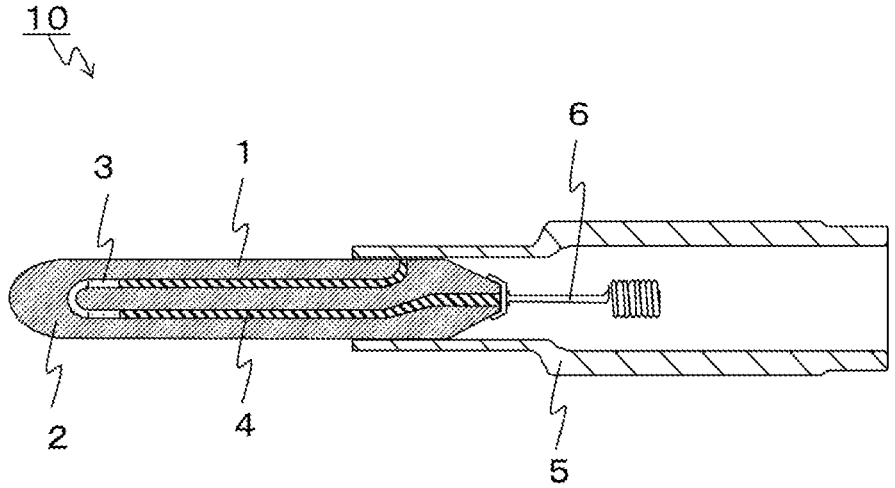
FIG. 6 is a cross-sectional view illustrating an example of a glow plug.

As illustrated in FIG. 6, a glow plug 10 includes the heater 1 described above and a cylindrical metal cylinder 5 which is attached so as to cover a rear end side (the other end side) of the heater 1. In addition, the glow plug 10 includes an electrode fitting 6 which is disposed inside the metal cylinder 5 and is attached to the rear end of the heater 1. According to the glow plug 10, rapid temperature rise is possible since the glow plug 10 uses the heater 1 described above.

The metal cylinder 5 is a member for holding the ceramic body 2. The metal cylinder 5 is a cylindrical member and is attached so as to surround a rear end side of the ceramic body 2. In other words, the rod-like ceramic body 2 is inserted into the cylindrical metal cylinder 5. The metal cylinder 5 is electrically connected to a lead 4-exposed portion which is located on a side surface near the rear end side of the ceramic body 2. The metal cylinder 5 is formed of, for example, a stainless steel or iron (Fe)-nickel (Ni)-cobalt (Co) alloy.

The metal cylinder 5 is bonded to the ceramic body 2 by a brazing material. The brazing material is disposed between the metal cylinder 5 and the ceramic body 2 so as to surround the rear end side of the ceramic body 2. By disposing this brazing material, the metal cylinder 5 and the leads 4 are electrically connected to each other.

As the brazing material, a silver (Ag)—copper (Cu) brazing material, an Ag brazing material, a Cu brazing material, or the like containing 5 to 20% by mass of a glass component can be used. The glass component has an excellent wettability with ceramics of the ceramic body 2 and a high coefficient of friction; thus, the glass component can improve a bonding strength between the brazing material and the ceramic body 2 or a bonding strength between the brazing material and the metal cylinder 5.

The electrode fitting 6 is located inside the metal cylinder 5 and is attached to the rear end of the ceramic body 2 so as to be electrically connected to the lead 4. While the electrode fitting 6 in various forms can be used, in an example illustrated in FIG. 6, the electrode fitting 6 is configured so that a cap section attached so as to cover the rear end of the ceramic body 2 together with the lead 4 and a coiled section electrically connected to an external connection electrode are connected to each other through a linear portion. This electrode fitting 6 is held apart from an inner circumferential surface of the metal cylinder 5 to prevent short-circuiting between the electrode fitting 6 and the metal cylinder 5.

The electrode fitting 6 is a metallic wire having the coiled section provided to alleviate a stress in connection to the external power supply. The electrode fitting 6 is electrically connected to the lead 4 and is also electrically connected to the external power supply. By applying a voltage between the metal cylinder 5 and the electrode fitting 6 by the external power supply, a current can be carried to the heat generating resistor 3 via the metal cylinder 5 and the electrode fitting 6. The electrode fitting 6 is formed of, for example, nickel or stainless steel.

The heater 1 can be formed by, for example, an injection molding method or otherwise using molds of the shapes of the heat generating resistor 3, the leads 4, and the ceramic body 2 configured as described above. As for the heat generating resistor 3, a molded body which has the two straight line sections 31*a* and 31*b* having the first major axis X and the second major axis Y parallel to each other and the folded section 32 is first prepared. A pressure is then applied to rear end sides of the two straight line sections 31*a* and 31*b*

(a side on which the two straight line sections 31*a* and 31*b* are not connected to the folded section 32) so that the second major axis Y is inclined with respect to the first major axis X in a state of fixing the folded section 32. In this way, it is possible to obtain the heat generating resistor 3 which has the second major axis Y inclined with respect to the first major axis X and which has a higher inclination as the first straight line section 31*a* and the second straight line section 31*b* are farther from the folded section 32.

REFERENCE SIGNS LIST

1: Heater
2: Ceramic body
3: Heat generating resistor
31*a*: First straight line section
31*b*: Second straight line section
32: Folded section
4: Lead
5: Metal cylinder
6: Electrode fitting
10: Glow plug
X: First major axis
Y: Second major axis

The invention claimed is:

1. A heater, comprising:

a ceramic body having a rod-like shape; and a heat generating resistor embedded in the ceramic body, the heat generating resistor comprising a first straight line section, a second straight line section which is disposed alongside the first straight line section, and a folded section which connects the first straight line section and the second straight line section, in a cross section of the heater taken along a plane which passes through the first straight line section and which is perpendicular to an axial direction of the ceramic body, the first straight line section having a shape having a first major axis, the second straight line section having a shape having a second major axis, the second major axis being inclined with respect to the first major axis, a centroid of the first straight line section and the second straight line section being deviated from a centroid of the ceramic body to a side on which a distance between the first major axis and the second major axis is narrower.

2. The heater according to claim 1, wherein in two cross sections of the heater which cross sections are taken along planes which pass through the first straight line section and which are perpendicular to the axial direction of the ceramic body, an inclination of the second major axis with respect to the first major axis in one cross section out of the two cross sections of the heater is higher than an inclination of the second major axis with respect to the first major axis in the other cross section, the one cross section being a cross section located farther from the folded section, the other cross section being located closer to the folded section.

3. The heater according to claim 2, wherein the inclination of the second major axis with respect to the first major axis is higher as the first straight line section and the second straight line section are farther from the folded section.

4. A glow plug, comprising:

a heater according to claim 1; and a metal holding member which holds the heater.

* * * * *